US010920990B2

(12) United States Patent
Tu

(10) Patent No.: US 10,920,990 B2
(45) Date of Patent: Feb. 16, 2021

(54) DRIVING DEVICE OF STOVE SAFETY PROTECTIVE EQUIPMENT

(71) Applicant: Tse-Ju Tu, Taoyuan (TW)

(72) Inventor: Tse-Ju Tu, Taoyuan (TW)

( * ) Notice: Subject to any disclaimer, the term of this patent is extended or adjusted under 35 U.S.C. 154(b) by 79 days.

(21) Appl. No.: 16/398,577

(22) Filed: Apr. 30, 2019

(65) Prior Publication Data

US 2020/0191401 A1 Jun. 18, 2020

(30) Foreign Application Priority Data

Dec. 12, 2018 (TW) ..... 107216888

(51) Int. Cl.
*F24C 3/12* (2006.01)
*F23N 5/22* (2006.01)

(52) U.S. Cl.
CPC . *F24C 3/12* (2013.01); *F23N 5/22* (2013.01)

(58) Field of Classification Search
USPC ..... 126/39 R, 39 BA, 39 E, 42, 39 N
See application file for complete search history.

(56) References Cited

U.S. PATENT DOCUMENTS

2003/0154970 A1* 8/2003 Huang ..... F24C 3/124 126/39 R

* cited by examiner

*Primary Examiner* — Vivek K Shirsat
(74) *Attorney, Agent, or Firm* — Rosenberg, Klein & Lee

(57) ABSTRACT

The invention relates to an improved driving device of stove safety protective equipment that is a driving device of driving a knob of a safety protective equipment to rotate and comprising a driving body, a first driving member, a clutch body, a second driving member and a driving tooth disc. When the knob is at an original position that does not ignite, the driving tooth disc integrally combined with the knob pushes the clutch body to allow the second driving member to mesh the driving tooth disc at idle state. The knob is smoothly rotated to implement ignition and regulation motions. At the same time, the driving body can also be rotated to enable the first driving member to move away from the clutch body so that the clutch body exactly and stably comes off the second driving member. The driving body rotates to allow the first driving member moving away from the clutch body, and the clutch body is driven to rotate to engage the second driving member. The second driving member rotates together and drives the driving tooth disc and the knob to restore and rotate so as to turn off stove fire, thereby achieving effect of enhancing stove usage safety.

5 Claims, 22 Drawing Sheets

DRIVING DEVICE OF STOVE SAFETY PROTECTIVE EQUIPMENT

BACKGROUND OF THE INVENTION

Field of the Invention

The present invention relates to an improved driving device of stove safety protective equipment, and more particularly to an improved driving device of stove safety protective equipment that is simply disposed, operated, used, capable of exactly and effectively enhancing stove usage safety so as to extremely match applicability, ideality and inventive step.

Description of the Related Art

Stoves, such as gas stoves or electric furnaces, are required facilities in a kitchen and will be applied while cooking or boiling water.

The stove may cause idle combustion, dry combustion on containers or cooking utensils because of careless behavior, resulting in fire. The foregoing fire accidents sometimes happen. For example, when working persons boil water or cook food, due to time consuming, they do not always stay in the kitchen and temporarily leave the kitchen or use the time to deal with other business. Consequently, working persons may forget that kitchen stove are performing boiling or cooking works, further resulting in danger situations of idle boiling and dry-combustion on containers and pots because of extremely long cooking/boiling time.

Thus, some operators have ever provided a gas stove protective device for preventing containers or pots from being dry-boiled. The manner is that containers or pots containing liquid are applied. When the weight of liquid evaporates to the set value because of long time boiling, gas source will be turned off to achieve the effect of preventing the containers or pots from being idle-boiling or dry-combusted. However, since types, materials and sizes of the containers or pots used by each person are different, the weights of containing liquids are not identical. By reducing the weights of the containers or pots containing liquids to the set value, the foregoing control manners and protective measures of forced-turning off gas due to the weights of the containers or pots containing liquids have obvious shortcomings in worse applicability and inaccuracy. More particularly, the protective device that is not applied to all containers or pots may restrict usage range and inconvenience with respect to consumers.

To improve the foregoing shortcomings, the operator(s) has applied Taiwan patent no. M554154 titled "Safety protective equipment for stove". As shown in FIGS. 1, 2, a safety protective equipment having alarm and effect of forced-turn off is disposed at an ignition switch rotation shaft of the stove. The safety protective equipment comprises a main body 10 and a driving device 20, a knob 30 and an electronic control device 40 mounted to the main body 10, wherein the driving device 20 is disposed with a driving tooth disc 2011 movably placed at the main body 10 and driven by the driving motor 202 and the driving gear 2012 to rotate. The knob 30 is placed in the piercing hole 101 of the main body 10 and combined to the driving tooth disc 2011 and the ignition switch rotation shaft 50 connected to and fixedly disposed to the stove. Accordingly, while rotating the knob 30 to implement stove ignition and cooking operation, the driving tooth disc 2011 of the transmission component 201 of the driving device 20 and the driving gear 2012 would be driven and rotate, and the electronic control device 40 would be activated to count time. When the predetermined cooking time comes and stove is not turned off, the electronic control device 40 would generate beep alarm. Afterward the driving device 20 drives the knob 30 to reversely rotate to perform motion of forced-turning off stove fire within the set time, thereby achieving effect and purpose of exactly enhancing stove usage safety.

Since the stove safety protective equipment is cooperated with mounting of the ignition switch rotation shaft 50 of a normal stove, the size must be reduced to achieve a smaller shape that does not occupy space. Under circumstance that is incapable of expanding the volume of the main body 10 due to restriction, the driving motor 202 and the transmission component 201 of the driving device 20 disposed to the main body 10 would also be at smaller state.

Further, the motion of ignition implemented by the stove is completed by working personal imposing powerful rotation torque on the knob 30 via a hand. When the driving device 20 enables the knob 30 to reversely rotate to perform motion of forced-turning off stove fire, similarity, the driving device 20 must be also forced by powerful torque. Since the driving gear 2012 meshed to the driving tooth disc 2011 in the driving device 20 is directly mounted and fixedly disposed to the rotation shaft 2021 of the driving motor 202, to drive the knob 30 to reversely rotate, the driving motor 202 must be produced at larger size in order to generate powerful torque. However, the size of the main body 10 has been restricted and is unable to be increased, and the size of the driving motor 202 is also restricted and unable to be effectively increased. In implementation, while using the stove safety protective equipment, it may produce sufficient torque. Consequently, unstably reverse rotation on the knob 30 may occur.

To overcome the foregoing shortcomings and provide better effect of using the stove safety protective equipment, the subsequent improved design through innovation of the inventor(s) is submitted.

SUMMARY OF THE INVENTION

Therefore, it is a primary objective of the present invention to provide an improved driving device of stove safety protective equipment that can improve the foregoing shortcomings and effectively prevent the stove from being dry-burned, idle-burning containers or pots so as to achieve effect of enhancing stove usage safety.

To achieve the foregoing objective, the invention relates to a driving device that drives knobs of safety protective equipment to rotate and comprising a driving body, a first driving member, a clutch body, a second driving member and a driving tooth disc. When the knob is at original position that does not ignite, the driving tooth disc integrally combined with the knob would push the clutch body so that the second driving member meshes the driving tooth disc at idle state, and the knob can be smoothly rotated to implement ignition and regulation motions. At the same time, the driving body can also be rotated to enable the first driving member moving away from the clutch body so that the clutch body exactly and stably comes of the second driving member. The driving body rotates to allow the first driving member to move away from the clutch body, and the clutch body rotates to engage the second driving member. The second driving member rotates together and drives the driving tooth disc and the knob to restore and rotate so as to turn off stove fire, thereby achieving effect of stove usage safety.

BRIEF DESCRIPTION OF THE DRAWINGS

FIG. 8-1 is a three-dimensional schematic diagram (I) of a first driving member according to the embodiment of the present invention;

FIG. 8-2 is a three-dimensional schematic diagram (II) of a first driving member according to the embodiment of the present invention;

FIG. 9-1 is a three-dimensional schematic diagram (I) of a transmission member of a clutch body according to the embodiment of the present invention;

FIG. 9-2 is a three-dimensional schematic diagram (II) of a transmission member of a clutch body according to the embodiment of the present invention;

FIG. 9-3 is a three-dimensional schematic diagram (I) of a carrier of a clutch body according to the embodiment of the present invention;

FIG. 9-4 is a three-dimensional schematic diagram (II) of a carrier of a clutch body according to the embodiment of the present invention;

FIG. 10-1 is a three-dimensional schematic diagram (I) of a second driving member according to the embodiment of the present invention;

FIG. 10-2 is a three-dimensional schematic diagram (II) of a second driving member according to the embodiment of the present invention;

DETAILED DESCRIPTION OF THE PREFERRED EMBODIMENTS

The technical characteristics, contents, advantages and effects of the present invention will be apparent with the detailed description of a preferred embodiment accompanied with related drawings as follows.

Figure 3:
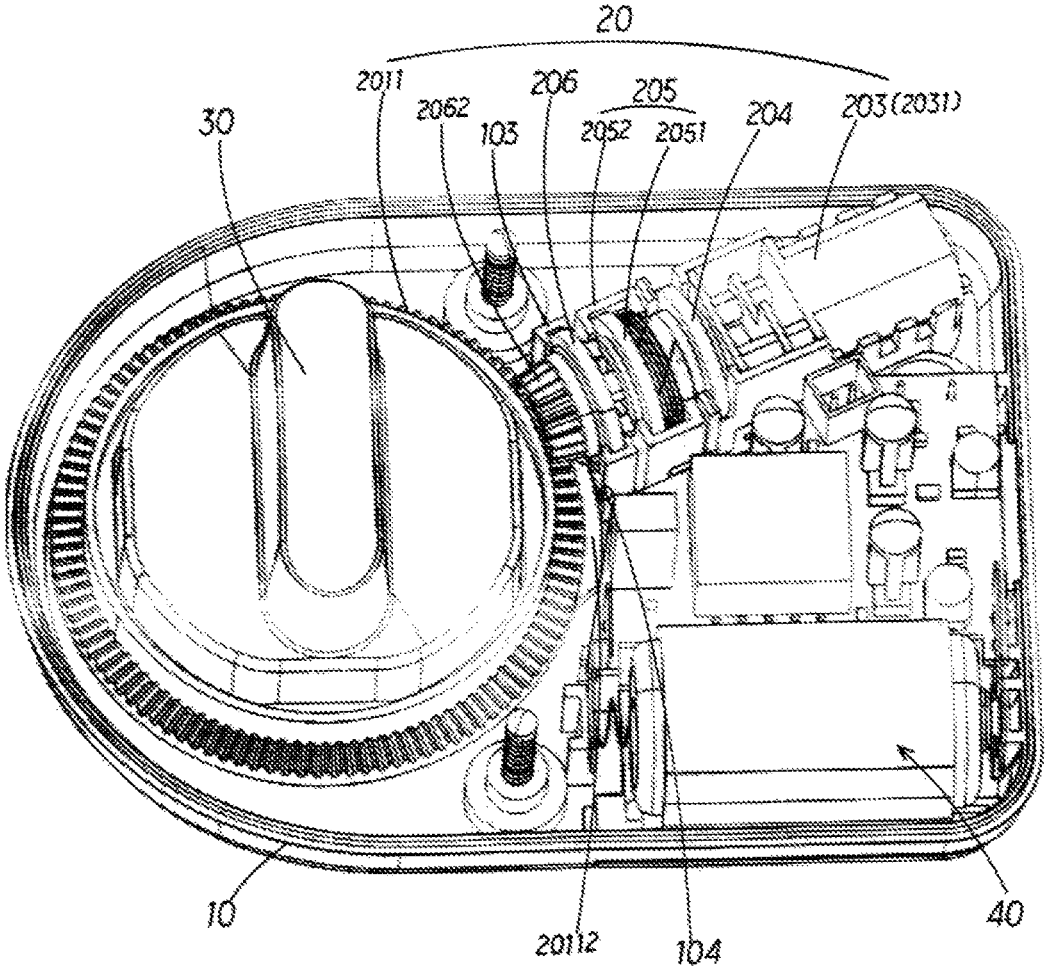
FIG. 3 is a three-dimensional schematic drawing of a driving device mounted to a safety protective equipment body according to the embodiment of the present invention.
Figure 4:
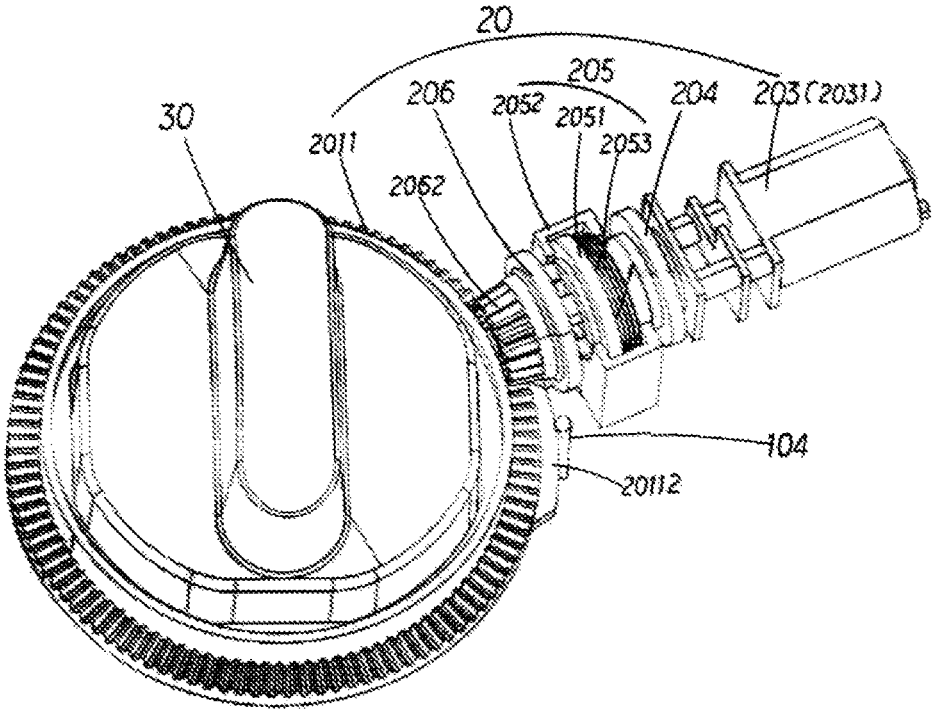
FIG. 4 is a three-dimensional schematic drawing of the driving device combined with a knob according to the embodiment of the present invention.
Figure 5:
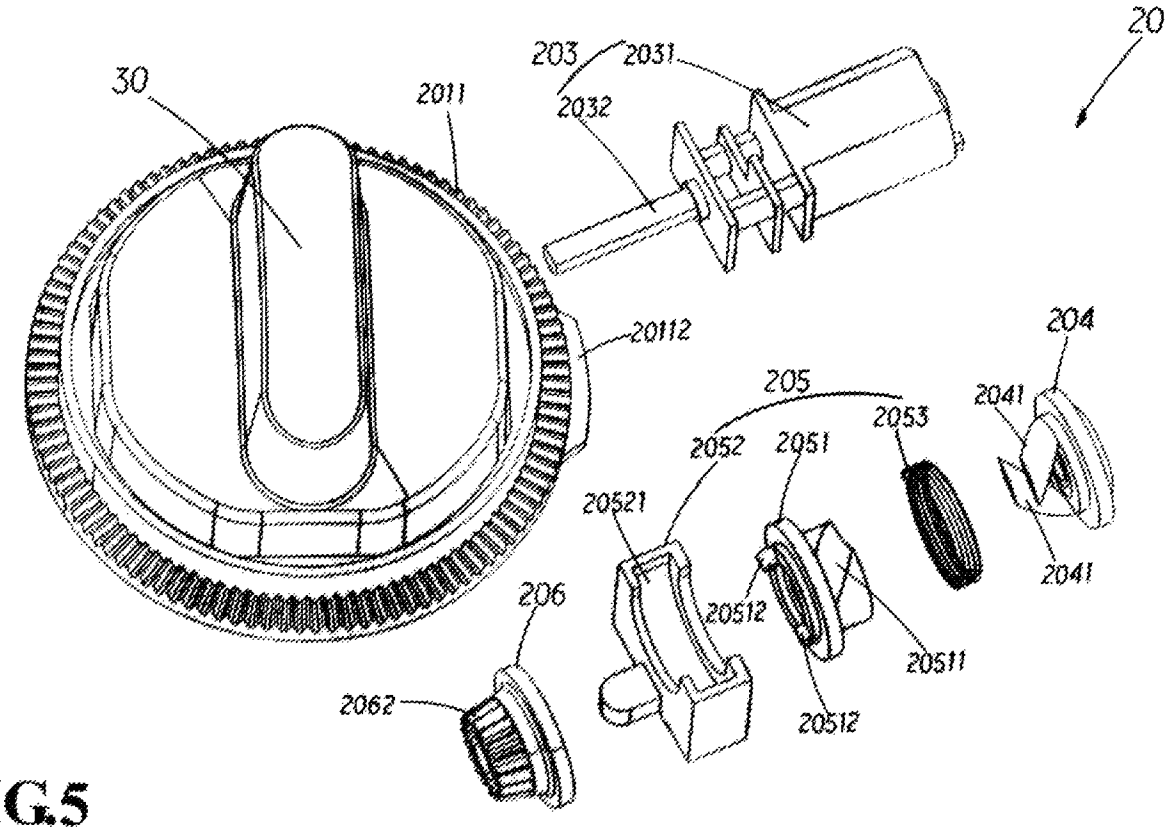
FIG. 5 is a decomposition structure drawing of the driving device according to the embodiment of the present invention.
Figure 6:
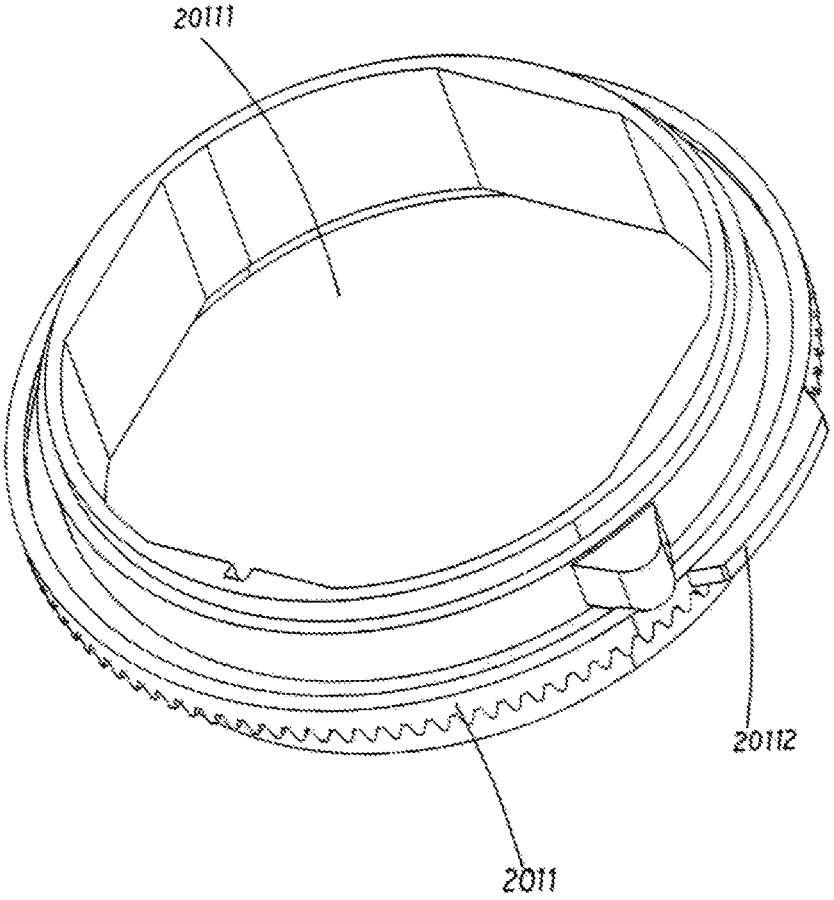
FIG. 6 is a three-dimensional structure drawing of a driving tooth disc according to the embodiment of the present invention.
Figure 7:
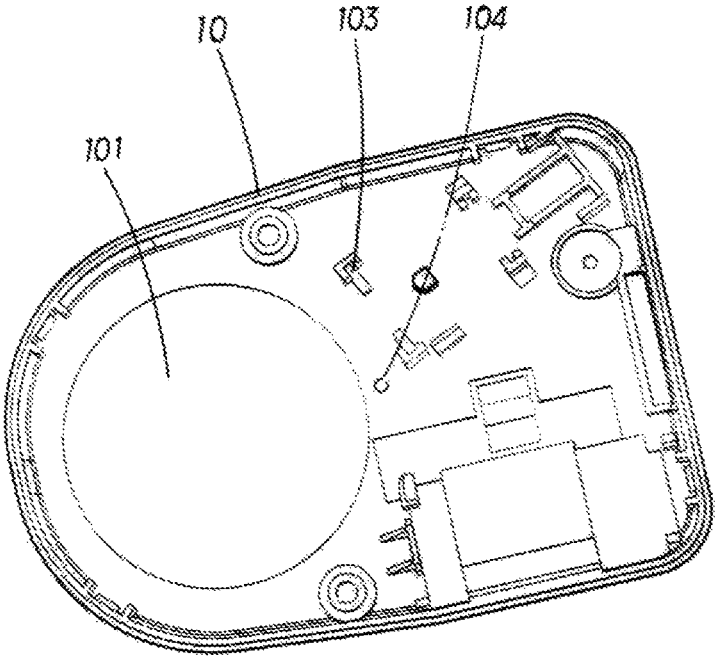
FIG. 7 is an upper view according to the embodiment of the present invention.

With reference to FIGS. 3, 4, 5, an improved driving device of stove safety protective equipment according to the invention comprises a main body 10 disposed to the stove safety protective equipment and a driving device 20 driving the knob 30 to rotate and containing a driving body 203, a first driving member 204, a clutch body 205, a second driving member 206 and a driving tooth disc 2011; wherein the knob 30 passes and is combined at a perforation containing hole 20111 (with reference to FIG. 6) in the center of the driving tooth disc 2011 and fixedly disposed at an ignition switch spindle of the stove. The driving tooth disc 2011 is lively placed at the main body 10 by freely rotating and disposed with at least a first push flange 20112 at periphery edge by corresponding to the perforation containing hole 101 (with reference to FIGS. 6, 7). A first push flange 20112 is disposed at the periphery edge. The first push flange 20112 mutually props against the sensing switch 104 disposed at the main body 10.

The driving body 203 is disposed at the main body 10 and disposed with a driving motor 2031. The driving motor 2031 can output high running torque to the output shaft 2032. Alternatively, the driving motor 20311 can output high running torque to the output shaft 2032 by collaborating with the deceleration mechanism.

Figure 1:
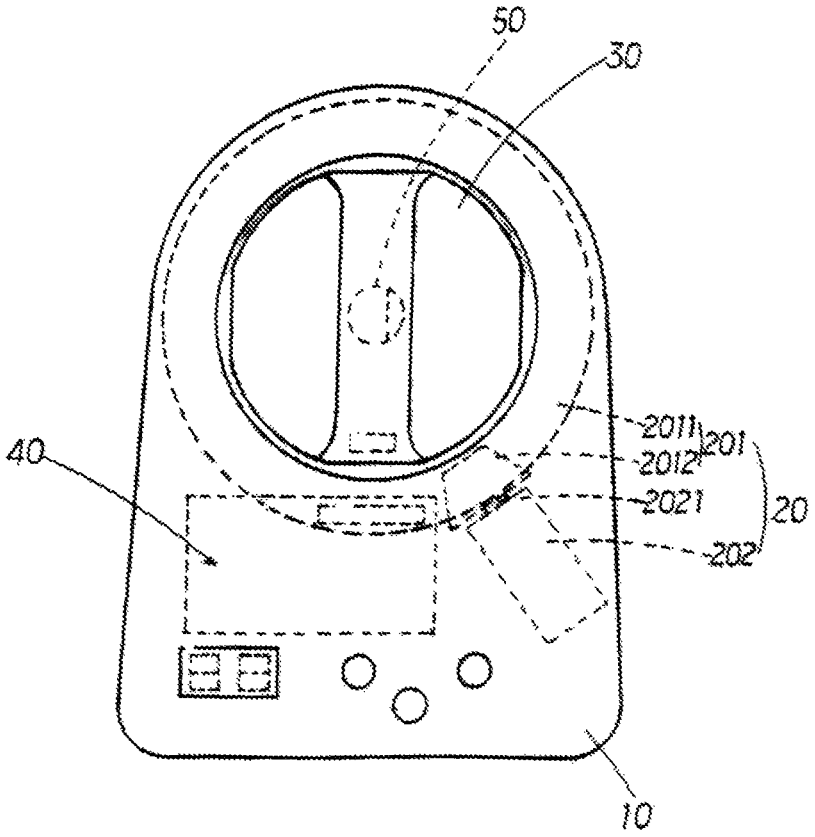
FIG.1 PRIOR ART
FIG. 1 is an upper view of Taiwan patent No. M554154.
Figure 2:
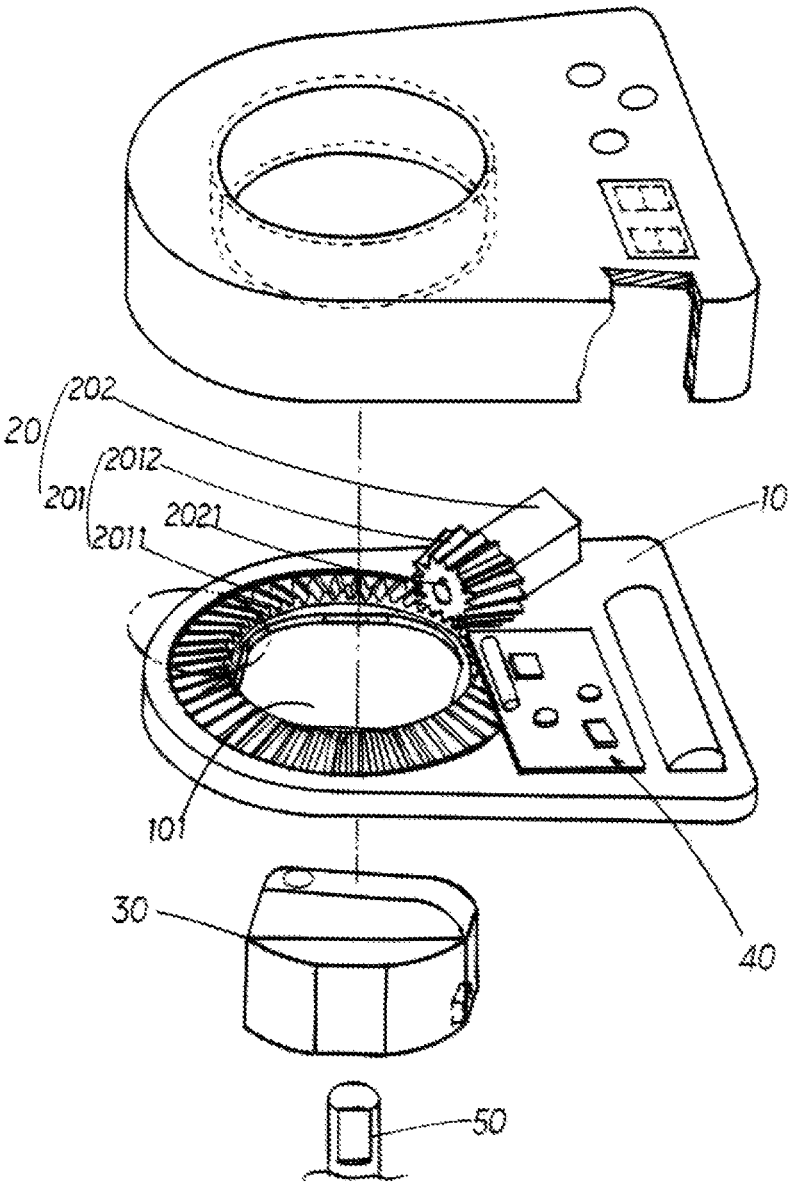
FIG.2 PRIOR ART
FIG. 2 is a decomposition structure drawing of Taiwan patent No. M554154.
Figures 2, 8:
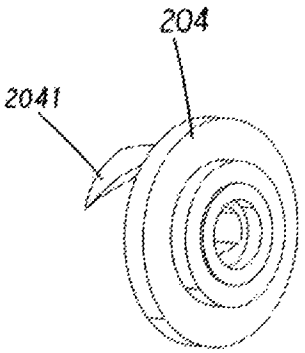
Figures 1, 8:
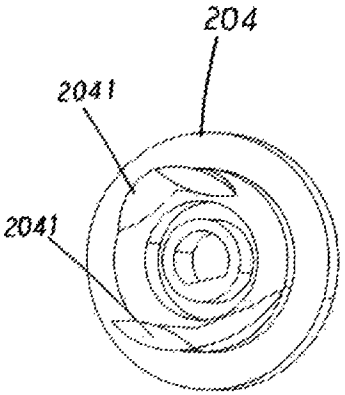
Figures 2, 9:
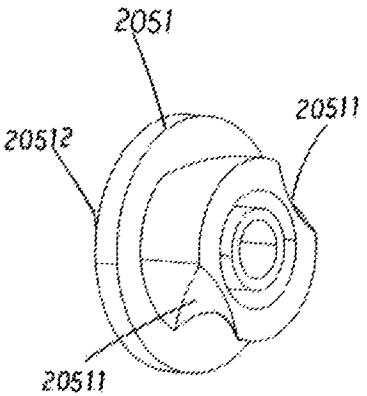
Figures 1, 9:
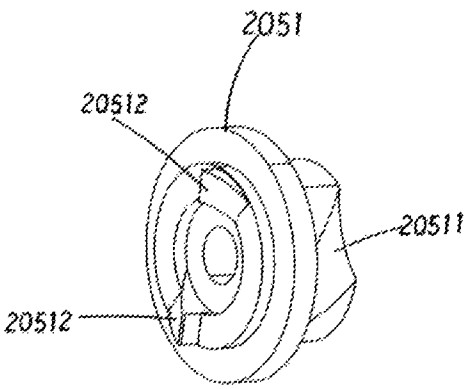
Figures 4, 9:
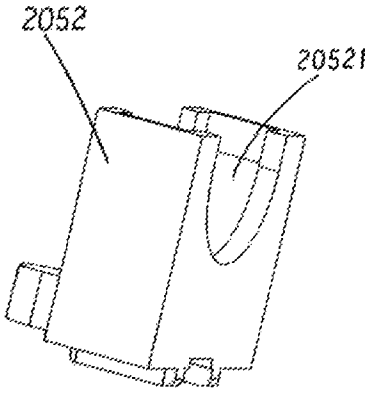
Figures 3, 9:
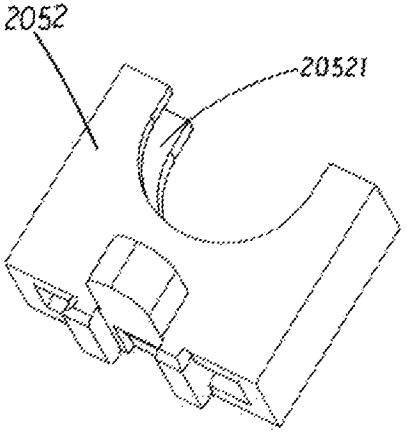

The first driving member 204 (with reference to FIGS. 8-1, 8-2) is mounted and fixedly disposed at the output shaft 2032 of the driving body 203 while a side is disposed with a first spiral tooth 2041 axially and outwardly protruding.

The clutch body 205 (with reference to FIGS. 9-1, 9-2, 9-3, 9-4) comprises a transmission member 2051 and a carrier 2052, wherein the transmission member 2051 is movably pivoted to the output shaft 2032 of the driving body 203 by free rotating and adjoins the first driving member 204. One side is disposed with at least a second spiral tooth 20511 outwardly protruding. The second spiral tooth 20511 is screwed with a first spiral tooth 2041 of the first driving member 204. At least a first engagement teeth 20512 is disposed at a relative side of the second spiral tooth 20511. The carrier 2052 is slidely disposed at the main body 10 without rotating and disposed with a containing slot 20521 for containing the transmission member 2051 by locating at the neighbor side of the first driving member 204. A flexible element 2053 is contained in the containing slot 20521. The flexible element 2053 closely leans against the transmission member 2051 so that the transmission member 2051 can be combined to the carrier 2052 without gaps. Accordingly, when the driving body 203 rotates to enable the first driving member 204 rotating, the first spiral tooth 2041 of the first driving member 204 would drive the driving member 2051 of the clutch body 205 to rotate during rotation. At the same time, since the transmission member 2051 is contained in the containing slot 20521 of the carrier 2052. The carrier 2052 is slidely placed at the main body 10 without rotation. The transmission member 2051 driven and rotated by the first driving member 204, at the same time, would be forwardly and backwardly pushed during rotation, and the carrier 2052 is also forwardly and backwardly pushed.

Figures 2, 10:
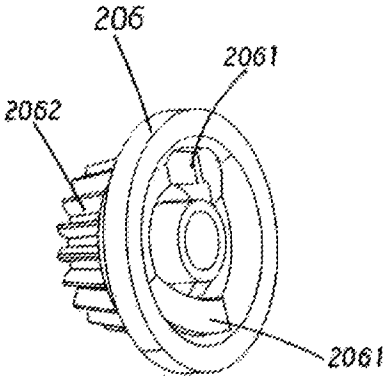
Figures 1, 10:
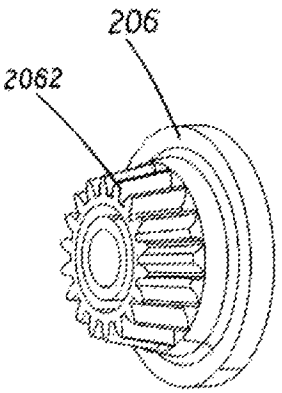

The second driving member 206 (with reference to FIGS. 10-1, 10-2) is movably pivoted at the output shaft 2032 of the driving body and adjoined to the clutch body 205 and, at a side, disposed with at least a second engagement teeth 2061 axially and outwardly protruding by movably placing at the position (with reference to FIG. 7) of the positioning slot 103 of the main body 10 without displacement. The second engagement teeth 2061 corresponds to the first engagement teeth 20512 of the transmission member 2051 of the clutch body 205. A driving gear 2062 is disposed at the relative side of the second engagement teeth 2061, wherein the quantity of the second engagement teeth 2061 is the same as the quantity of the first engagement teeth 20512 of the transmission member 2051 of the clutch body 205 and much better the driving gear 2062 meshes the driving tooth disc 2011 anytime.

Figure 11:
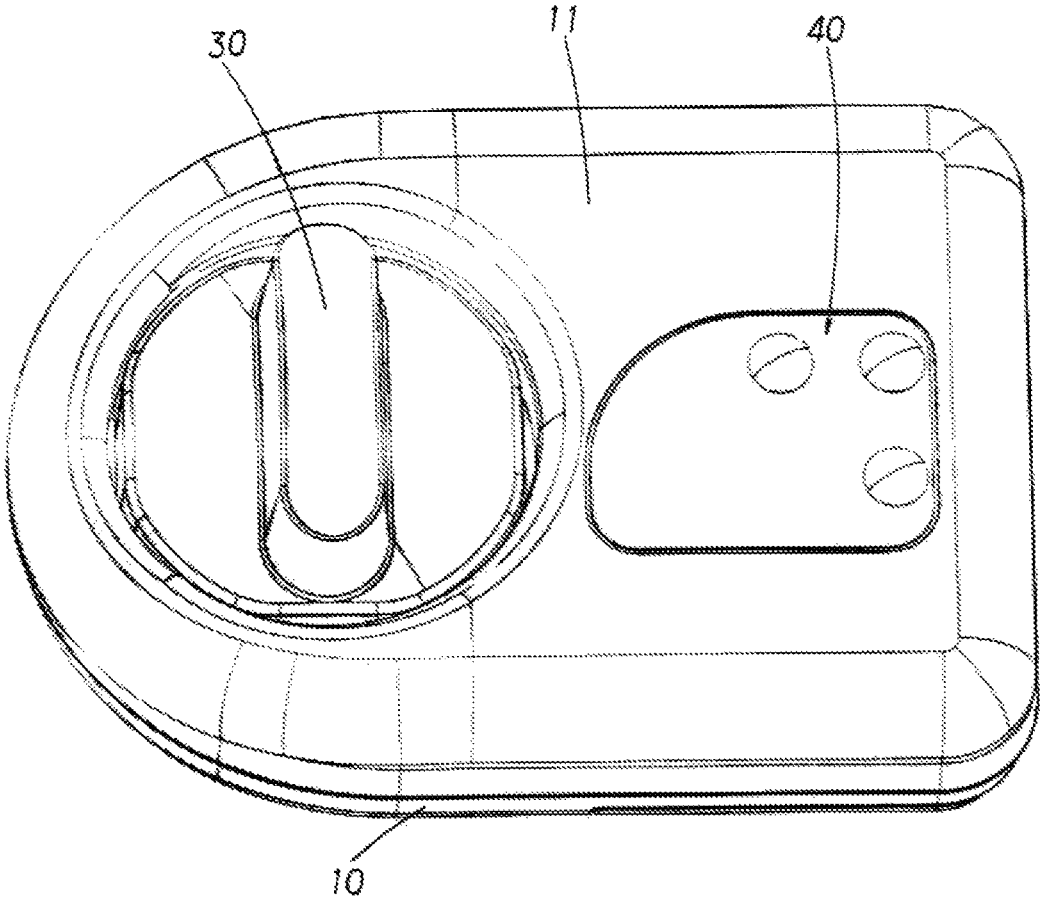
FIG. 11 is a three-dimensional schematic diagram of the driving device hidden and disposed in the main body according to the embodiment of the present invention.
Figure 12:
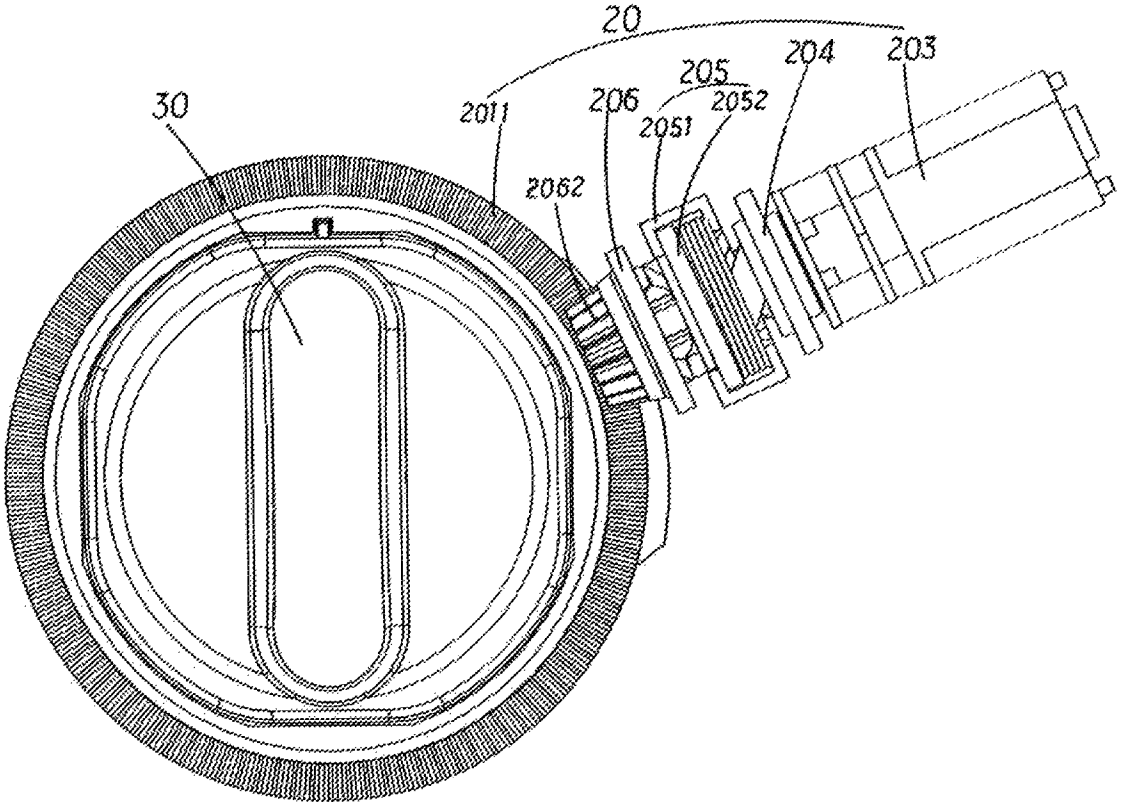
FIG. 12 is an upper view schematic diagram (I) of operation of the driving device according to the embodiment of the present invention.
Figure 13:
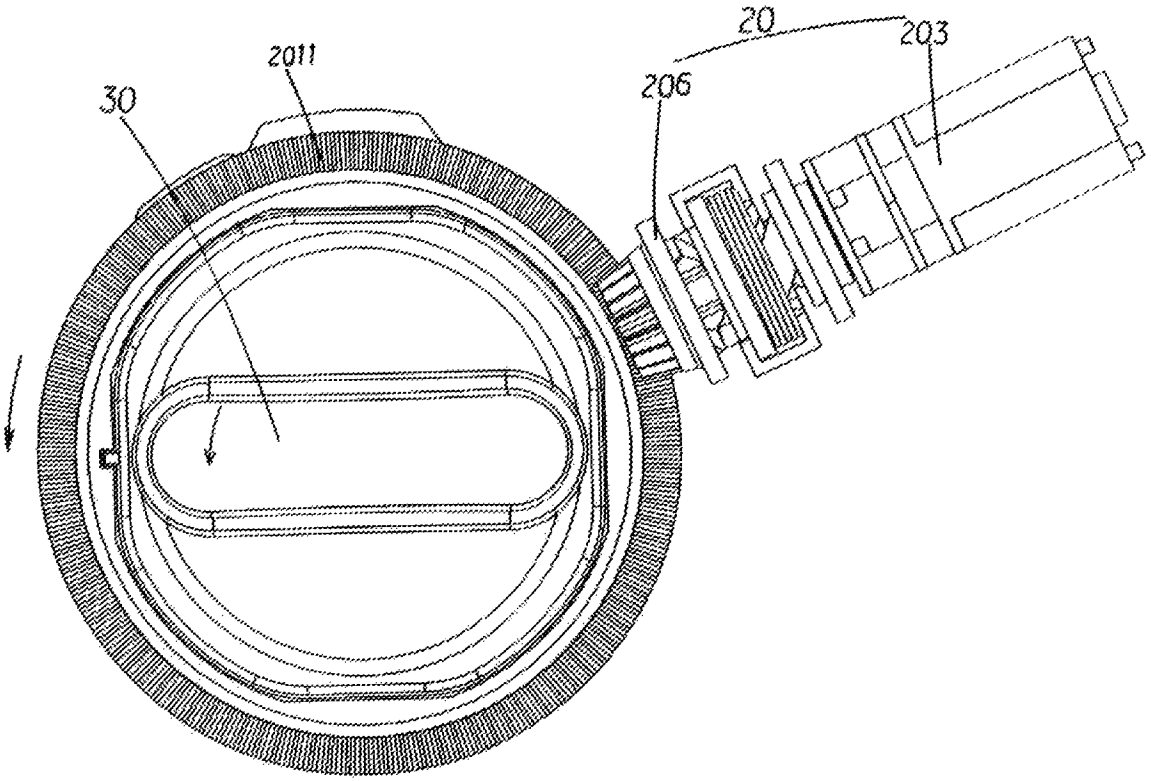
FIG. 13 is an upper view schematic diagram (II) of operation of the driving device according to the embodiment of the present invention.
Figure 14:
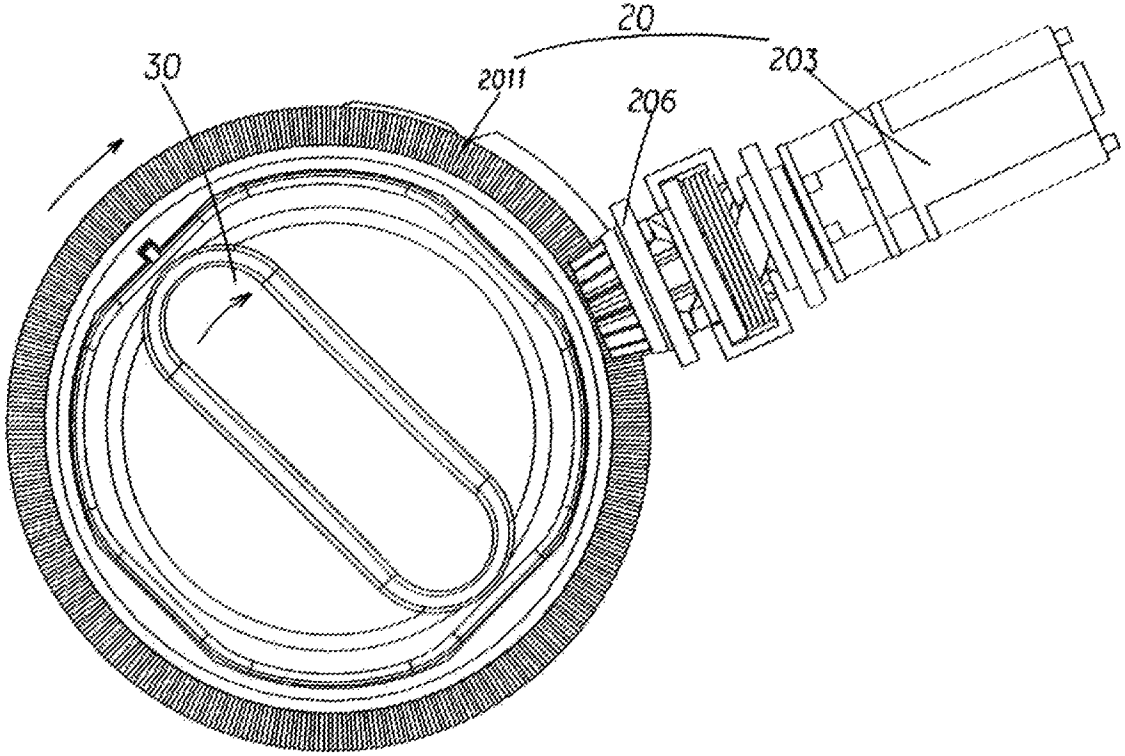
FIG. 14 is an upper view schematic diagram (III) of operation of the driving device according to the embodiment of the present invention.
Figure 15:
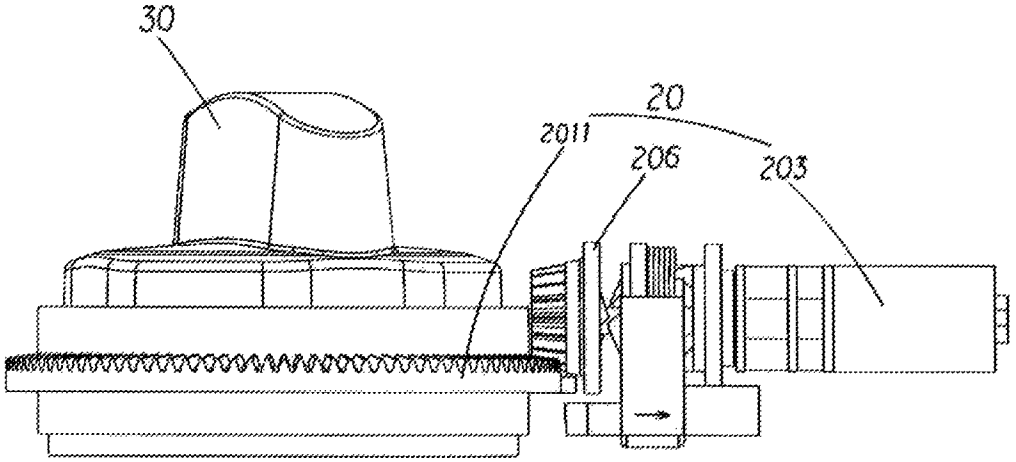
FIG. 15 is a front view schematic diagram according to FIG. 14.
Figure 16:
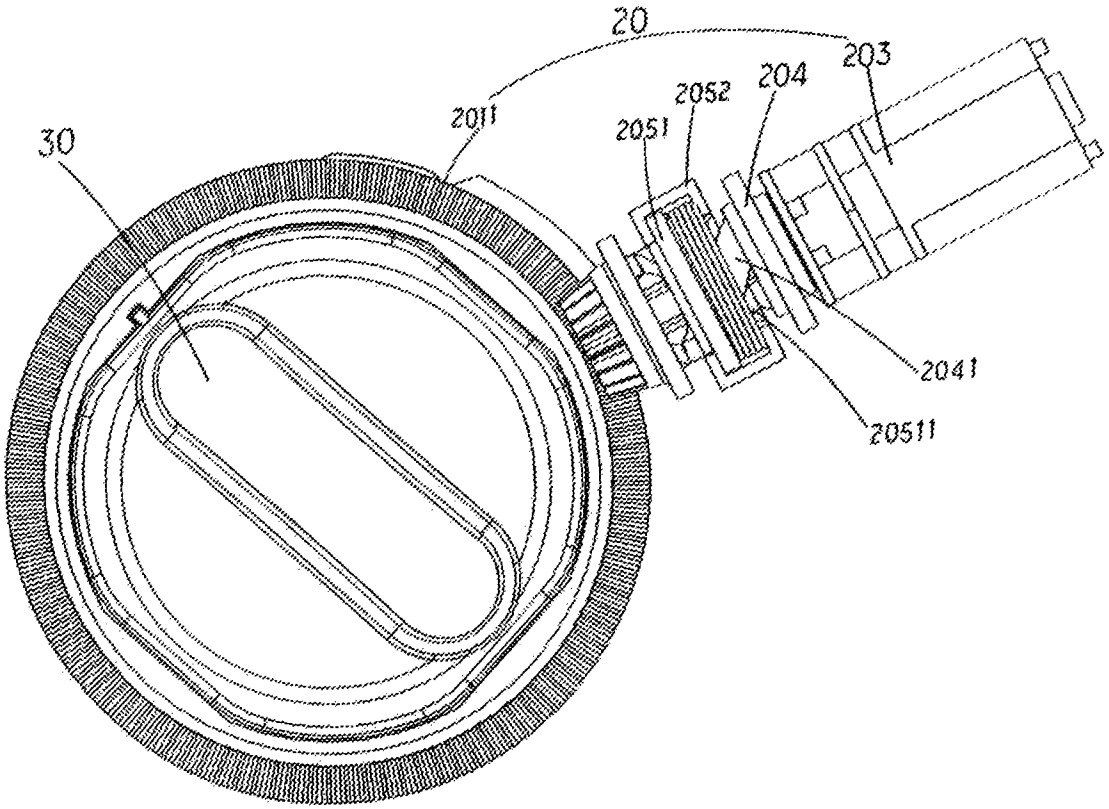
FIG. 16 is an upper view schematic diagram (IV) of operation of the driving device according to the embodiment of the present invention.
Figure 17:
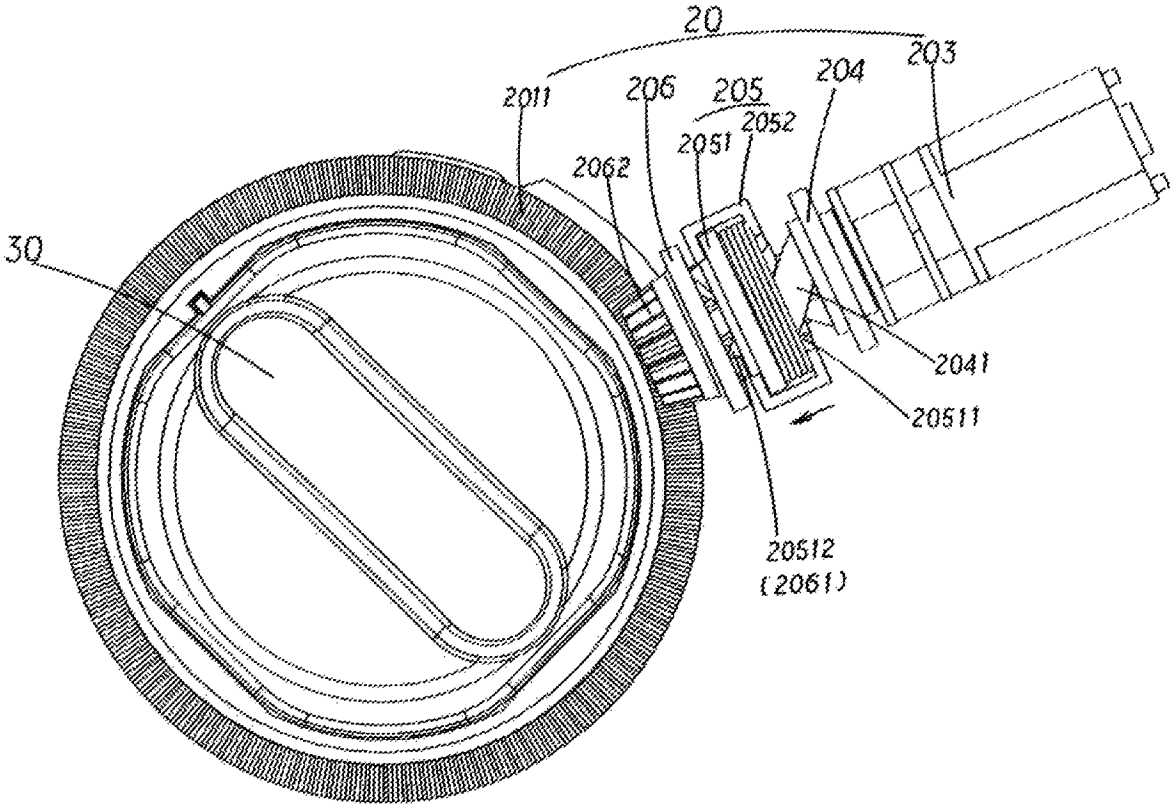
FIG. 17 is an upper view schematic diagram (V) of operation of the driving device according to the embodiment of the present invention.
Figure 18:
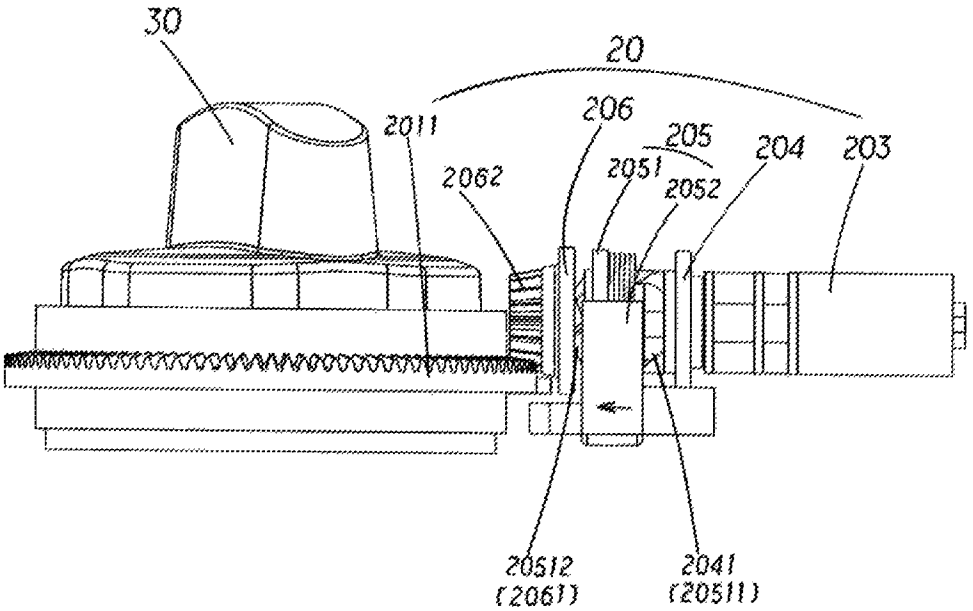
FIG. 18 is a front view schematic diagram according to FIG. 17.
Figure 19:
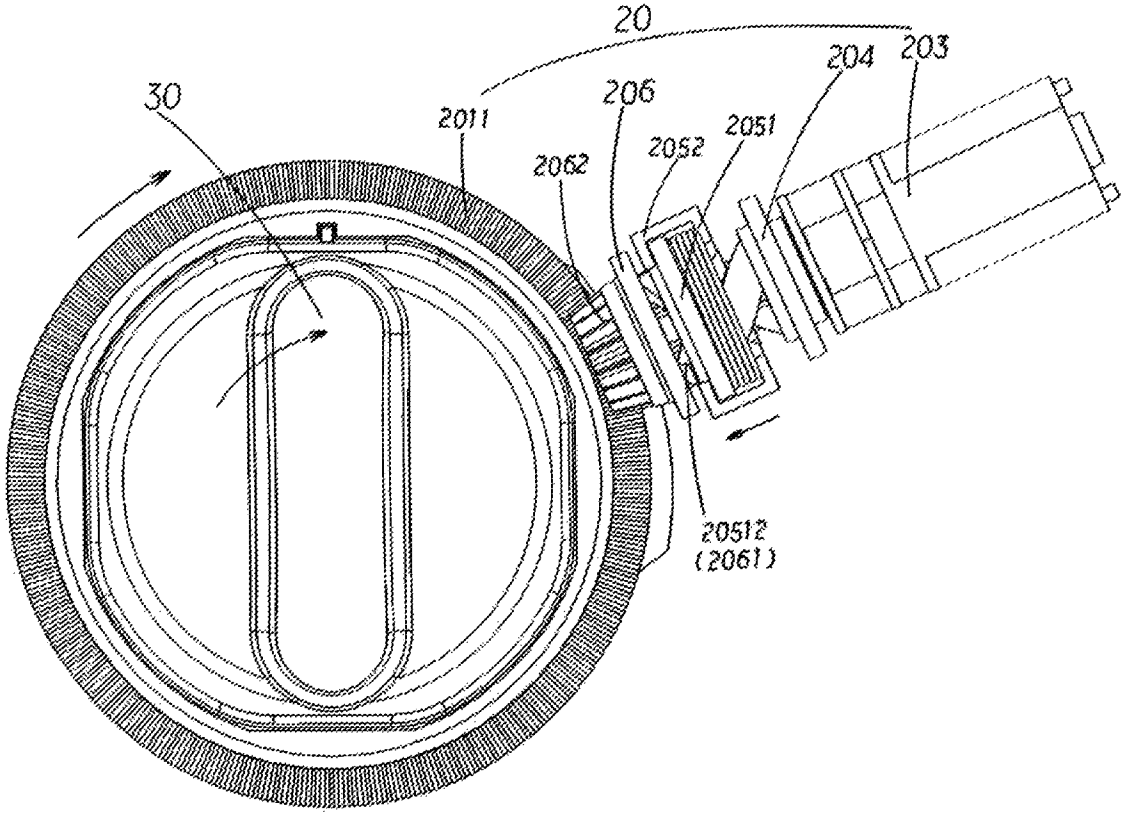
FIG. 19 is an upper view schematic diagram (VI) of operation of the driving device according to the embodiment of the present invention.
Figure 20:
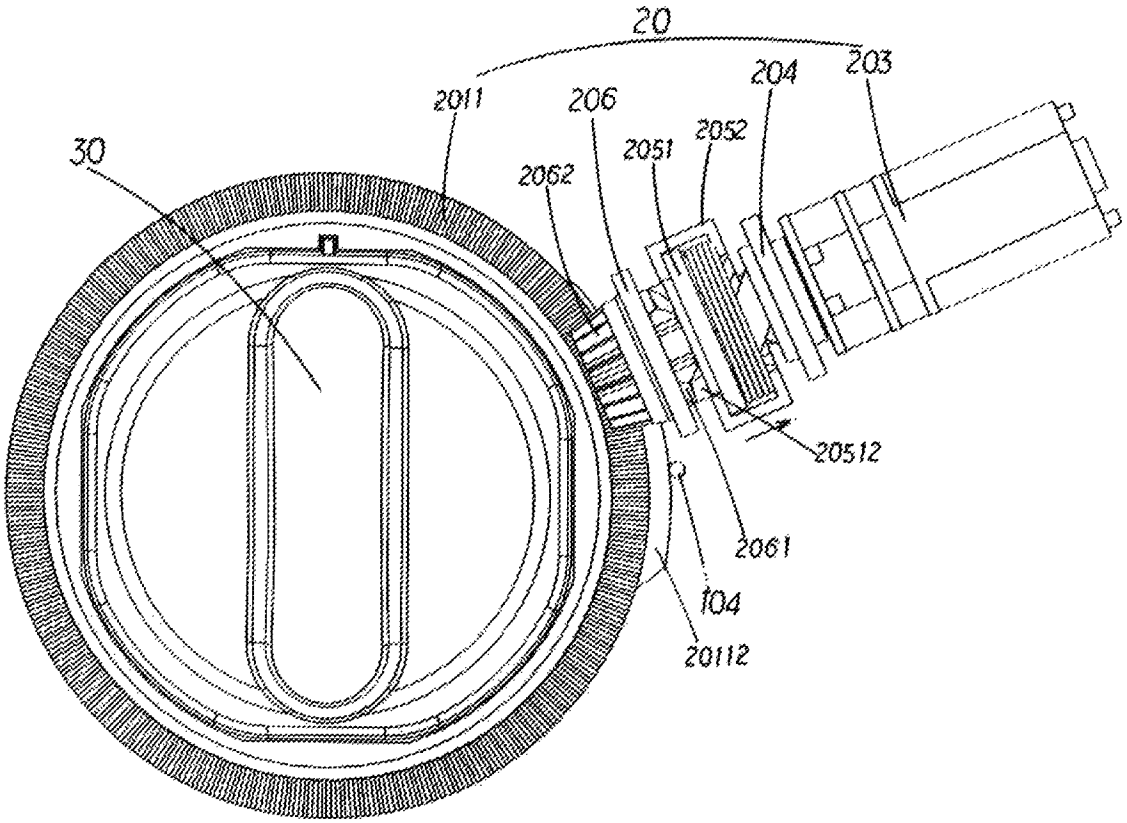
FIG. 20 is an upper view schematic diagram (VII) of operation of the driving device according to the embodiment of the present invention.
Figure 21:
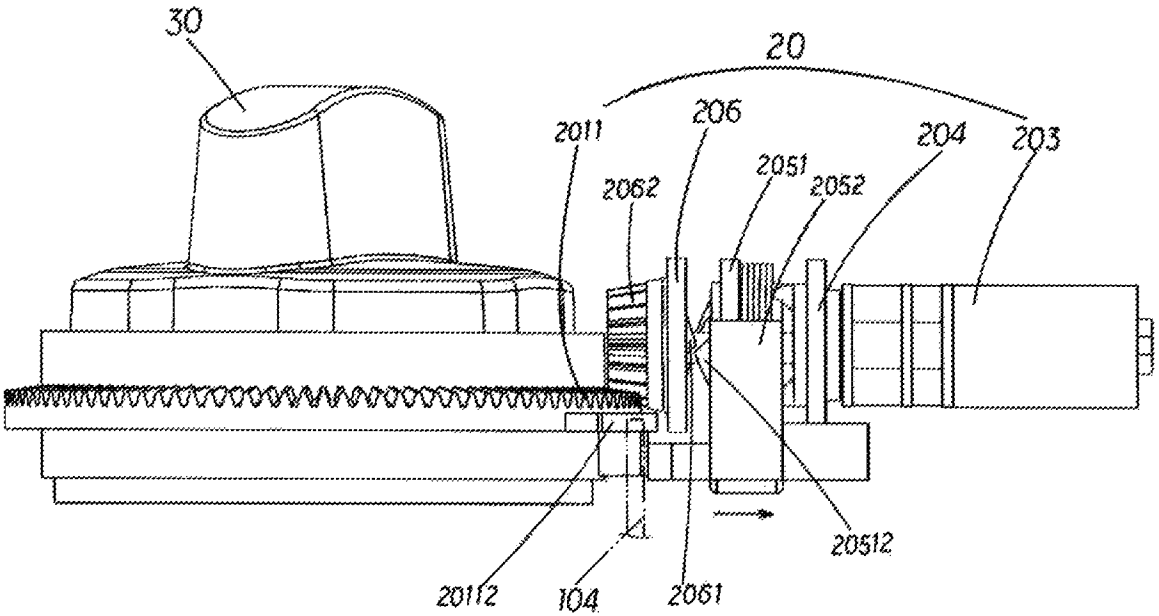
FIG. 21 is a front view schematic diagram according to FIG. 20.

By utilizing the foregoing components, with reference to FIG. 11, the driving device 20 can be completely hidden and contained in the main body 10 after covering a main body cover 11.

After mounting the stove safety protective equipment at the ignition switch rotation shaft of the stove, with reference to FIGS. 12-21, when the stove is not ignited to operate cooking and the knob 30 locates at original position (with reference to FIG. 12), the driving body 203 of the driving device 20 will not active. The transmission member 2051 of the clutch body 205 is separated from the second driving member 206. The second driving member 206 is at idle state so that the driving gear 2062 meshes the driving tooth disc 2011.

Afterward cooking operation is implemented. Setting the cooking time for an electronic control device 40 (with reference to FIG. 11) of the stove safety protective equipment, and the knob 30 is rotated to ignite the stove. When the driving tooth disc 2011 operates together (with reference to FIG. 13), the driving body 203 of the driving device 20 retains inactive state. Since the second driving member 206 continuously uses free rotation state to mesh the driving tooth disc 2011, motion of rotating the knob 30 has smoothness and may not be interfered completely.

Afterward while rotating the knob 30 to regulate stove fire (with reference to FIGS. 14, 15), the driving body 203 of the driving device 20 does not act, and the second driving member 206 uses free rotation state to mesh the driving tooth disc 2011. The motion of rotating knob 30 still has operating smoothness effect.

When set cooking time comes, and the knob 30 of the stove is not turned off thorough operating persons, the driving body 203 of the driving device 20 will be automatically initiated (with reference to FIG. 16) to drive and rotate the first driving member 204. Since the second spiral teeth 20511 of the transmission member 2051 of the clutch body 205 is mutually screwed with the first spiral teeth 2041 of the first driving member 204, the transmission member 2051 contains the carrier 2052, which does not rotate, slidely placed at the main body 10. Therefore, when the first driving member 204 is driven and rotated, the transmission member 2051 of the clutch body 205 will be driven and rotated and is forwardly pushed one by one. The carrier 2052 of containing the transmission member 2051 is forwardly pushed together to allow the clutch body 205 to gradually approach the direction of the second driving member 206. Afterward when the clutch body 205 is forwardly pushed by the first driving member 205 and rotation of the first engagement teeth 20512 of the transmission member 2051 of the clutch body 205 engages the second engagement teeth 2061 of the second driving member 206 (with reference to FIGS. 17, 18), the second driving member 206 is instantly driven and rotated. Accordingly, since the driving gear 2062 of the second driving member 206 meshes the driving tooth disc 2011 anytime, the second driving member 206 can drive the driving tooth disc 2011 to rotate one by one, and the knob 30 integrally combined with the driving tooth disc 2011 rotates to restore so as to perform motion of forced-turning off stove fire (with reference to FIG. 19).

After the knob 30 and the driving tooth disc 2011 are driven by the driving device 20 to reversely rotate to perform motion of forced-turning off stove fire (with reference to FIGS. 20, 21), the first push flange 20112 disposed to the driving tooth disc 2011 exactly leans against and presses the sensing switch 104 disposed to the main body 10 when the knob 30 is restored to original position. The sensing switch 104 instantly controls the driving body 203 of the driving device 20 to reversely rotate through the electronic control device 40 so that the first driving member 204 brings the clutch body 204 to immediately and backwardly displace, and the first engagement teeth 20512 of the transmission member 2051 completely and exactly removes off the second engagement teeth 2061 of the second driving member 206. The second driving member 206 can meshes the driving tooth disc 2011 by instantly restoring as idle state at free rotation. The knob 30 can smoothly perform preparation and operation functions for next rotation.

With cooperation of the driving body 203, the first driving member 204, the clutch body 205, the second driving member 206 and the driving tooth disc 2011 of the driving device 20, when the stove is ignited or regulated with fire operation, the knob 30 can be smoothly rotated and operated. When cooking time comes and the user does not turn off stove fire, the knob 30 can be exactly, smoothly, stably, and reversely rotated to automatically implement motion of forced-turning off stove fire, thereby achieving effect of exactly and effectively enhancing stove usage safety.

In another word, using the invention has the following advantages:

1. Disposition is simple to have economy.
2. The knob can be reversely rotated to perform motion of forced-turning off stove fire so as to have smoothness, practicality, and stability.
3. The stove usage safety can be exactly and effectively enhanced.

While the present invention has been described by means of specific embodiments, numerous modifications and variations could be made thereto by those skilled in the art without departing from the scope and spirit of the invention set forth in the claims.

What is claimed is:

1. An improved driving device of stove safety protective equipment being a driving device having a main body connected to a stove safety protective equipment and driving a knob to rotate, the driving device comprising a driving body, a first driving member, a clutch body, and a second driving member and a driving tooth disc;

wherein the knob is combined with the driving tooth disc and mounted and affixed to an ignition switch rotation shaft of the stove, the driving tooth disc is rotatably mounted in the main body, and the driving body is disposed within the main body and includes a driving motor and an output shaft;

wherein the driving motor outputs torque to the output shaft, the first driving member is mounted on the output shaft of the driving body for rotation therewith, one side of the first driving member having at least one first spiral tooth axially protruding therefrom, the clutch body including a transmission member and a carrier, and the transmission member being disposed on the output shaft of the driving body and being rotatable thereon and adjoining the first driving member; and wherein one side of the transmission member has at least one second spiral tooth axially protruding therefrom, the second spiral tooth being engaged with the first spiral tooth of the first driving member, a side of the transmission member opposite to the one side having the at least one second spiral tooth having at least one first engagement tooth, the carrier being slidably positioned in the main body adjacent the first driving member and having a containing slot formed therein and into which the transmission member is received, the second driving member being located in a positioning slot formed in the main body and being rotatable about an axis thereof, one side of the second driving member having at least one second engagement tooth axially protruding therefrom toward the transmission member, the at least one second engagement tooth being disposed in correspondence to the at least one first engagement tooth of the transmission member of the clutch body, and an opposing side of the transmission member having a driving gear meshingly engaged the driving tooth disc to thereby complete the improved driving device of stove safety protective equipment.

2. The improved driving device of stove safety protective equipment of claim 1, wherein a periphery of the driving tooth disc is provided with a first push flange, the first push flange contacts a sensing switch to control the driving body for rotating.

3. The improved driving device of stove safety protective equipment of claim 1, wherein the containing slot of the carrier of the clutch body contains a flexible element, the flexible element contacts the transmission member.

4. The improved driving device of stove safety protective equipment of claim 1, wherein the second driving member is pivotally mounted on the output shaft of the driving body for rotation about the output shaft.

5. The improved driving device of stove safety protective equipment of claim 1, wherein the transmission member has a quantity of the first engagement teeth greater than one and the second driving member has a quantity of the second engagement teeth greater than one, the quantity of the second engagement teeth of the second driving member being the same as the quantity of the first engagement teeth of the transmission member of the clutch body.

* * * * *